United States Patent [19]

Dolansky

[11] 4,384,721

[45] May 24, 1983

[54] OIL EXPLORATION GAME

[76] Inventor: George Dolansky, C 17 Colfax Ave./N., Woodside Gardens North, Roselle Park, N.J. 07204

[21] Appl. No.: 199,967

[22] Filed: Oct. 23, 1980

[51] Int. Cl.[3] ..... A63F 3/00

[52] U.S. Cl. ..... 273/237; 273/287; 273/278; 273/254

[58] Field of Search ..... 273/236, 244, 245, 251, 273/252, 254, 256, 278, 284, 287; 434/299

[56] References Cited

U.S. PATENT DOCUMENTS

| | | | |
|---|---|---|---|
| 2,460,264 | 1/1949 | Prentice | 273/284 |
| 3,247,683 | 4/1966 | Dankner | 63/31 |
| 3,568,357 | 3/1971 | Lebensfeld | 273/237 |
| 3,729,198 | 4/1973 | Shaffer | 273/287 |
| 3,844,567 | 10/1974 | Marker | 273/287 |
| 4,025,075 | 5/1977 | Priska | 273/278 |

*Primary Examiner*—Richard J. Apley
*Assistant Examiner*—David J. Brown
*Attorney, Agent, or Firm*—Leitner, Palan, Martin & Bernstein

[57] ABSTRACT

An oil exploration game including a box-shaped game board with an upper playing surface and lower supporting surface with a rotatable cam located between such surfaces and having reremovably mounted game pieces some of which are operatively connected to the rotatable cam and further including information indicia means for recording events associated with the playing of the game.

11 Claims, 6 Drawing Figures

FIG.1
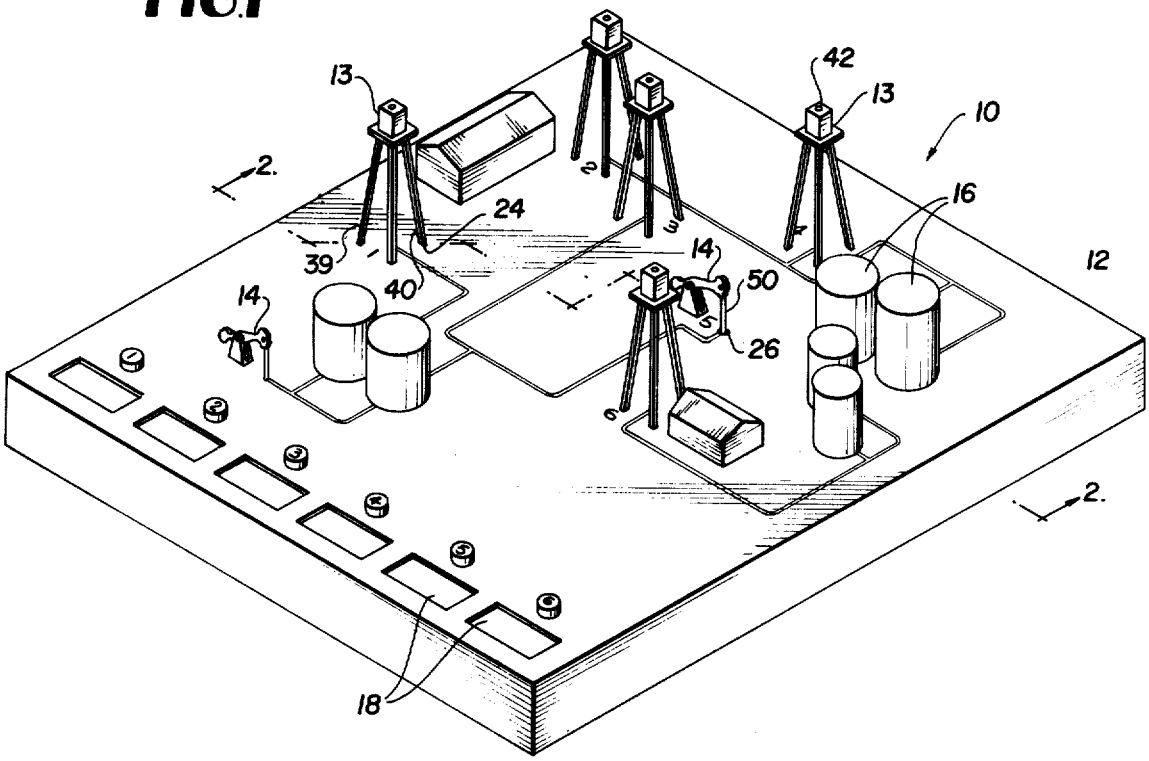
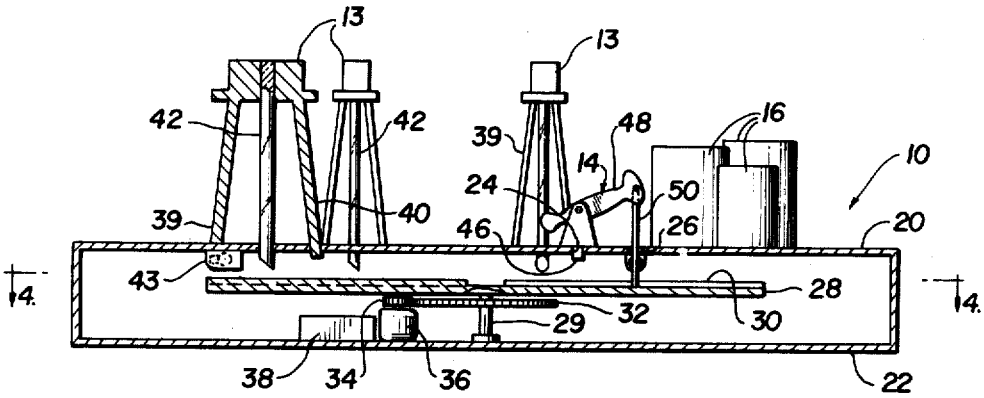
FIG.2

OIL EXPLORATION GAME

BACKGROUND OF THE INVENTION

The present invention relates generally to the field of games, and more particularly to a new and improved oil drilling game, playable by two or more players utilizing a chance device. Games involving the exploration and drilling for oil have been available commercially over the past several years. In recent years, however, the availability of oil has been a subject of increasing concern and the subject of oil exploration a topic of great interest. Even children in their pre-teens are being made aware of the importance of conserving energy because of the limited supply of oil and, further that political and world events are closely related to oil and its availability. It has been recognized that great economic advantages accrue to those who own and control producing oil supplies. The present invention has been designed to employ many structural features simulating actual oil drilling apparatus and while being relatively simple to play, the game directly involves the participants in actual oil production techniques.

The initial phases of the game are directed to the participant's acquiring oil drilling locations after which the game proceeds so that each participant has an opportunity to "drill" for oil. Once a player has successfully drilled for oil, and has set up an oil production facility, the other players, under certain conditions, must pay "money" to the producing oil well owner. The player with the most "money" at the end of the game is declared the winner.

SUMMARY OF THE INVENTION

Accordingly, it is an object of this invention to provide a game simulating the drilling for oil utilizing a chance device and having structure to simulate an actual oil drilling environment.

It is another object of this invention to provide a game having an oil drilling environment that is relatively simple to play.

According to the invention, there is provided an oil exploration game having a box-shaped game board and removably mounted game pieces simulating oil derricks, oil storage tanks and donkey pumps. Located within the game board interior are the necessary mechanisms that operatively interrelate with the removably mounted game pieces in a manner that results in the realistic simulation of the oil drilling operation.

In the preferred embodiment of the invention, information indicia means are provided to allow the player to be visually informed as to the amount of simulated distance that has been drilled in the pursuit of oil at a particular oil derrick location. Further, there is provided structure that realistically simulates a working oil pump or donkey pump once it has been determined that a player has "struck" oil by having drilled the necessary distance.

Other objects, advantages and novel features of the present invention will become apparent from the following detailed description of the invention when considered in conjunction with the accompanying drawings.

BRIEF DESCRIPTION OF THE DRAWINGS

FIG. 1 is a perspective view of a completely set-up game with a complete representation of all removably mounted pieces in operative positions.

FIG. 2 illustrates a vertical cross-section taken on line 2—2 of FIG. 1.

DETAILED DESCRIPTION OF THE PREFERRED EMBODIMENT

Figure 3:
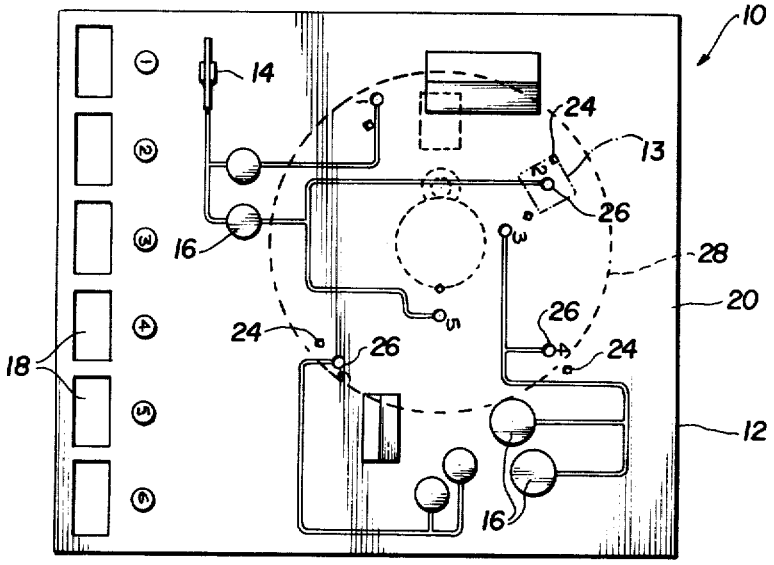
FIG. 3 is a plan view of the top surface of the game board without the simulating oil exploration devices.

Referring now to the drawings in detail, wherein like reference materials indicate like parts throughout the several figures, reference numeral 10 indicates the oil exploration game of the present invention.

FIG. 1 represents a perspective view of the oil exploration game with all of its various components assembled for playing of the game. Game 10 is seen to include a game board 12 having oil derricks 13, donkey pumps 14, oil storage sheds 16 and depth indicating means 18 operationally set-up for actual playing of the game.

Figure 4:
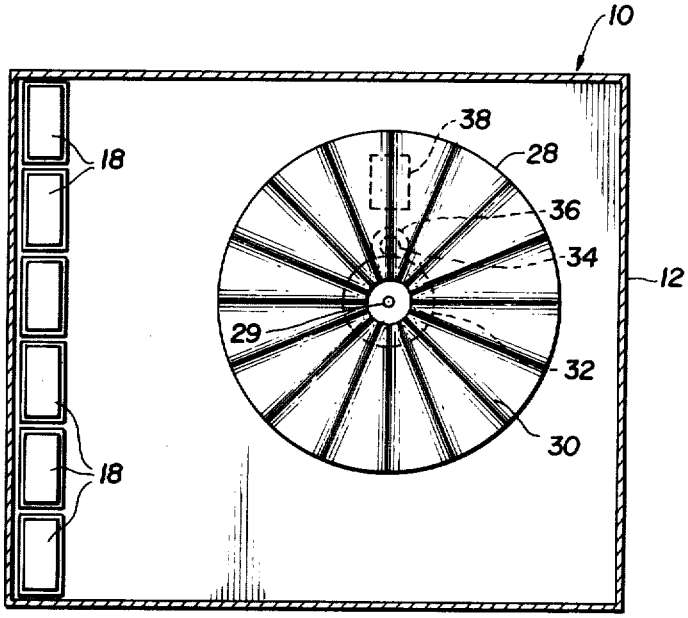
FIG. 4 is a horizontal cross-section taken on line 4—4 of FIG. 2.

Referring to FIGS. 2, 3, and 4 of the drawings, game board 12 is shown to be comprised of an upper surface 20 and a lower surface 22. Upper surface 20 is the exposed playing surface and for that purpose may be provided with designs simulating an actual oil drilling operation. Irregularly shaped support holes 24 and communications holes 26 are provided on surface 20 as shown in FIG. 3 for purposes to be described in greater detail below. Simulated depth indicating means 18, the purpose of which will be explained below, is also provided on surface 20 as shown.

Located between surface 20 and 22 is disc 28 rotatably mounted on vertical shaft 29 upon which is positioned an undulate cam surface 30 the purpose of which will be explained in greater detail below. The rotation of disc 28 with undulate cam surface 30 may be provided by any known suitable rotation driving apparatus, however, in the disclosed embodiment the rotational driving apparatus consists of a gear arrangement wherein gear wheel 32 mounted on vertical shaft 29 is driven via gear drive 34 powered by electric motor 36. Operatively connected to the electric motor in any suitable manner well known in the art is power supply means 38 which may be a low voltage rechargeable battery or electrical transformer means connectable to commercially available 110 volt power source. It is understood that the electrical power necessary to power the various components of the game will be supplied by any suitable means known in the art and forms no part of the invention.

Figure 5:
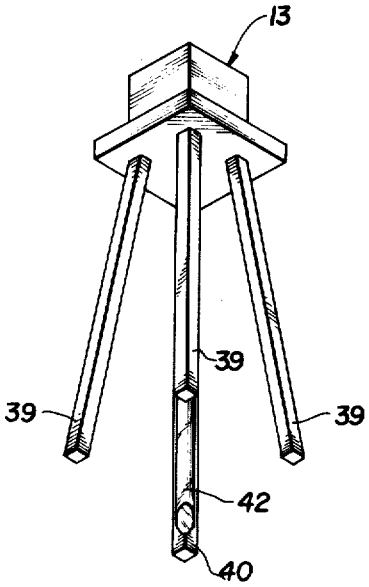
FIG. 5 illustrates an oil derrick used in the game.
Figure 6:
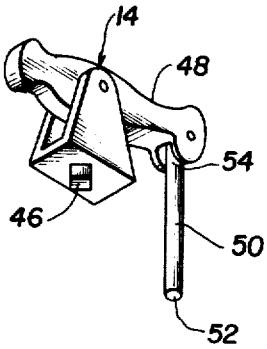
FIG. 6 illustrates a donkey pump used in the game.

Oil derricks 13 are removably mounted on upper surface 20 of game board 12 and for that purpose each oil derrick 13 is provided with three equal length legs 39 and one longer leg 40 as shown in FIG. 5. Leg 40 of each oil derrick 13 is designed to be received in irregularly shaped support holes 24 so that there can be no rotation of leg 40 after it has been inserted in its support hole 24. A lucite rod 42 is provided at the vertical center of each oil derrick 13 with its lower end extending below leg 40 so that when oil derrick 13 is mounted on playing surface 20 with its leg 40 in support hole 24, the rod 42 is positioned with the lower end thereof extending through and beneath communication hole 26. A light source 43 mounted below and adjacent each communication hole 26 is electrically connected to depth indicating means 18 so that rod 42 is automatically illuminated when it has been determined that oil has been struck as explained in more detail below. (The wires are deleted for the sake of clarity.)

Donkey pumps 14 are removably mounted in place of oil derricks 13 on upper surface 20 of game board 12 at an appropriate time in the playing of the game and are therefore each provided with a support leg 46 designed to fit into a respective non-circular irregularly shaped hole 24. Donkey pump arm 48 is pivotably attached to support leg 46. Rod 50 is pivotably connected to arm 48 and is inserted in its respective communication hole 26 such that the bottom end 52 rests on cam surface 30 of disc 28. Upper end 54 of rod 50 is operatively attached to donkey pump pivot arm 48 such that rotation of disc 28 results in vertical reciprocation of rod 50 and pivoting of arm 48 thereby simulating operation of an actual donkey pump. It is to be understood that the operation of each donkey pump 14 is meant to represent the process of the reclamation of oil from the earth's interior and to that end, respective supply pipelines may be pictorally represented on upper surface 20 as connecting donkey pumps 14 to oil storage sheds 16.

A depth indicating means 18 is provided for each oil derrick location and serves the function of keeping the players aware of the amount of drilling that has occured at its respective oil derrick location. Any suitable commercially available counter with a display capability can be used, but in the preferred embodiment numbers are to be displayed representing the depth measure in feet that a particular derrick location has reached in its drilling operation at any given time. Actuation of the depth indicating means 18 will advance the numerical reading a predetermined amount. Upon successive actuations the numerical reading of depth indicating means 18 will indicate a depth referred to as the strike distance that represents the predetermined depth measure in feet at which oil is located. As indicated above, appropriate visual indication, preferably a light source, is connected to the depth indicating means 18 and is automatically actuated upon the depth indicating means reaching the value equal to the strike distance. In the preferred embodiment, the light source illuminates the rod 42 so that the players of the game are made visually aware that the strike distance has been reached at a particular oil derrick 13.

The operation of the game board vis-a-vis the game pieces is as follows: The game board 12 is set up so that all oil derricks are in their respective location having each leg 40 in its respective support hole 24 and each rod 42 in its respective communication hole 26. Oil storage sheds 58 are likewise positioned on playing surface 20. Depth indicating means 18 are set to a zero reading. The game can begin pursuant to the rules as explained below. During the course of the game when a drilling operation of a particular oil derrick has begun, the amount of feet drilled at any given time is visually displayed on the respective depth indicating means 18 associated with that particular oil derrick 13. When the strike distance has been reached, the light source is actuated and rod 42 is illuminated. The player owner of that oil derrick removes the oil derrick 13 and replaces it with a donkey pump 14 and its associated rod 50 as explained above. During the course of that player's turn the power means 38 is actuated to cause rotation of disc 28 and cam surface 30 resulting in the pivoting of arm 48 of donkey pump 14 to simulate oil reclamation. From that time on during the course of playing the game, power means 38 may continually drive the cam surface 30 so that there is constant motion and activity of the donkey pumps 14.

The game is assembled with the associated pieces including the operational oil derricks mounted in place.

The game is designed to be played by two or more players. Each player is initially given an amount of play money. A chance device is provided which may be in the form of dice, spinner, cards, or the like. In the preferred embodiment, a pair of 6-faced dice are provided. One dice may be red and the other may be black, although other forms of indicia may be used to distinguish the two dice. Each face is provided with a number such that the 6 faces of each dice will have numbers 1–6 respectively.

To start the game, each player takes turns to roll the red dice. The number exposed on the red dice will determine the numbered oil derrick which that player will own. The red dice is thrown by subsequent players in turn until all the oil derricks are under ownership by one of the players, and the second phase of the game may then be started.

After all oil derricks and their respective locations are under control and ownership of respective players, the dice are thrown by each player in a predetermined turn. The numbers on the red dice represent the respective numbered oil derrick; the numbers on the black dice represent values measured in feet of distance to drill into the earth. At the beginning of the game the depth measured in feet at which oil is located beneath the oil derricks is determined by the players.

As an example, if a player throws both dice with the red dice exposing the face having the number 6 and the black dice exposing the face having the number 5, it is then determined that oil derrick number 6 will be drilled a number of feet equal to 5 times the amount of predetermined feet per unit. Assuming the agreed upon depth of oil supply or strike distance is 1,000 feet below the earth and 10 feet is the predetermined per unit amount, then oil derrick 6 will have drilled $5 \times 10$ or 50 feet into the earth leaving 950 feet to drill before striking oil. Subsequent amounts are added to the indicia measuring means 18 such that the cumulative drilled amount for each oil derrick is stored and displayed.

When the strike distance has been reached on a particular derrick, the appropriate rod 42 is illuminated. The depth recording means can be programmed for automatic actuation of the light source. The player who owns that particular derrick removes same from the board, replaces it with a donkey pump. From that time on during the course of playing the game any time that player exposes the number on the red dice corresponding to that well he must pay the owner of that well a predetermined amount of money. The person with the most money at the end of the game is declared the winner.

From the preceding description of the preferred embodiments, it is evident that the objects of the invention are obtained and a novel oil exploration game is provided. Although the invention has been described in detail, it is clearly understood that the same is by way of illustration and example only and is not to be taken by way of limitation. The spirit and scope of this invention is to be limited by the terms of the appended claims.

What is claimed is:

1. An oil exploration game including a box-shaped game board having an upper playing surface and a lower supporting surface;

rotatable cam means located in the space between said upper playing and said lower support surface;

information indicia means for recording events associated with the playing of the game;

removably mounted game pieces located on said upper playing surface, at least one of said removably mounted game pieces being a pump;

means operatively connecting said pump to said rotatable cam means; and means to rotate said cam substantially continuously at some point in the game to drive said pump to effectuate pumping action.

2. An oil exploration game as defined in claim 1, wherein the removably mounted game pieces include oil derricks and donkey pumps.

3. An oil exploration game as defined in claim 2, wherein each of said donkey pumps include an arm capable of pivoting in response to said connecting means being actuated by said rotatable cam means.

4. An oil exploration game as defined in claim 2, wherein each of said information indicia means is used to visually display the depth drilled at a respective oil derrick location.

5. An oil exploration game as defined in claim 2, wherein said oil derricks and said donkey pumps are alternatively removably mounted in the same position on said playing surface.

6. An oil exploration game as defined in claim 1, wherein chance means are provided in the playing of the game.

7. An oil exploration game as defined in claim 6, wherein said chance means include two dice each of which represent different aspects of the game.

8. An oil exploration game as defined in claim 1, wherein electrical power means are provided to operate said rotatable cam and said information indicia means.

9. An oil exploration game including a box-shaped game board having an upper playing surface and a lower supporting surface;

removably mounted game pieces located on said upper playing surface, including at least one derrick;

depth indicating means, located on said game board for indicating the depth to which said derrick is drilled;

oil striking indicating means connected to said depth indicator means for indicating that said derrick has struck oil when said depth indicating means has reached a predetermined value;

said oil striking indicating means including light indication means having a rod connected to said derrick above said upper surface and between said upper and lower surfaces and a light source located between said upper and lower surfaces, adjacent said rod, for illuminating said rod above said upper surface.

10. An oil exploration game including a box-shaped game board having an upper playing surface and a lower supporting surface;

removably mounted game pieces located on said upper playing surface, including at least one derrick;

depth indicating means, located on said game board for indicating the depth to which said derrick is drilled;

oil striking indicating means connected to said depth indicator means for indicating that said derrick has struck oil when said depth indicating means has reached a predetermined value;

a rotatable cam means located in the space between said upper playing and said lower support surfaces;

at least one pump game piece; and connector means to rotate said cam substantially continuously at some point in the game to drive said pump to effectuate a pumping action.

11. An oil exploration game including a box-shaped game board having an upper playing surface and a lower supporting surface;

removably mounted game pieces located on said upper playing surface, including at least one derrick;

depth counter means spaced apart from said derrick and located on said upper playing surface for indicating incrementally and cumulatively the depth to which a particular derrick is drilled;

said depth counter means having a predetermined value for representing when oil is struck; and oil striking indicating means including a light indication means directly connected to a particular derrick and actuated by said depth counter means for automatically and instantaneously indicating that said particular derrick has struck oil when said depth counter means has reached to said predetermined value.

* * * * *